US007445458B1

(12) United States Patent
Yamane

(10) Patent No.: US 7,445,458 B1
(45) Date of Patent: Nov. 4, 2008

(54) COAXIAL ELECTRICAL CONNECTOR

(75) Inventor: Masahiro Yamane, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 12/081,067

(22) Filed: Apr. 10, 2008

(30) Foreign Application Priority Data

Apr. 25, 2007 (JP) ..... 2007-115233

(51) Int. Cl.
*H01R 12/00* (2006.01)

(52) U.S. Cl. ..... 439/63

(58) Field of Classification Search ..... 439/63, 439/581, 582, 668, 669, 947, 589, 578, 79
See application file for complete search history.

(56) References Cited

U.S. PATENT DOCUMENTS 6,607,400 B1 * 8/2003 Ko ..... 439/581
6,648,653 B2 * 11/2003 Huang et al. ..... 439/63
6,843,673 B1 * 1/2005 Liu et al. ..... 439/188
6,902,408 B2 * 6/2005 Yamane ..... 439/63
6,997,745 B2 * 2/2006 Ikeda ..... 439/582
7,217,156 B2 * 5/2007 Wang ..... 439/579
7,367,840 B2 * 5/2008 Chen et al. ..... 439/581
2004/0102061 A1 * 5/2004 Watanabe ..... 439/63
2006/0009075 A1 * 1/2006 Nagata et al. ..... 439/581
2006/0024985 A1 * 2/2006 Nagata et al. ..... 439/63
2006/0094297 A1 * 5/2006 Wang ..... 439/578

FOREIGN PATENT DOCUMENTS

JP 2006-66384 3/2006

* cited by examiner

*Primary Examiner*—Neil Abrams
*Assistant Examiner*—Phuong Nguyen
(74) *Attorney, Agent, or Firm*—Kubotera & Associates, LLC

(57) ABSTRACT

A coaxial electrical connector includes an outer conductive body including a fitting portion having an opening portion for receiving a mating connector on one end portion side in a direction of an axis line, and an attachment portion formed of a surface perpendicular to the axis line on the other end portion side for attaching to a circuit board, and extending to substantially cover an area inside of a peripheral border of the fitting portion through a joining portion bent at a part of the peripheral border; a dielectric body retained and held inside of the fitting portion; and a central conductive body including a contact portion for contacting a mate central conductive body, a connection portion extending from the dielectric body in a radial direction and situated on a bottom surface of the attachment portion, and a retained portion for covering the retained portion.

6 Claims, 5 Drawing Sheets

COAXIAL ELECTRICAL CONNECTOR

BACKGROUND OF THE INVENTION AND RELATED ART STATEMENT

The present invention relates to a coaxial electrical connector. More specifically, the present invention relates to a coaxial electrical connector attached to a circuit board for connecting with a mating coaxial electrical connector in a direction perpendicular to a surface of the circuit board.

A conventional coaxial electrical connector that is attached to a circuit board for use has been disclosed in, for example, Patent Reference.

Patent Reference Japanese Patent Publication No. 2006-66384

In Patent Reference, the conventional coaxial connector having a male type central conductive body is attached to one of two opposing circuit boards, and a coaxial connector having a female mold central conductive body is attached to the other circuit board. The two circuit boards face each other. The two coaxial connectors are then fitted into each other to connect the circuit boards.

According to Patent Reference, an outer conductive body of each coaxial connector has a fitting tubular portion. The fitting tubular portion is made of a round metal sheet in a cylinder shape. Further, an attachment portion for the circuit board protrudes from the fitting tubular portion outwardly from a radial direction to be integrated with the fitting tubular portion.

The fitting tubular portion is provided with a slit in a part thereof along a circumference direction. The slit extends in parallel to an axis line of the fitting tubular portion. The slit elastically expands a diameter thereof in a radial direction, so that the fitting tubular portion easily fits with a fitting tubular portion of the mating connector.

In the conventional coaxial connector disclosed in Patent Reference, the attachment portion that is integrated with the fitting tubular portion of the outer conductive body protrudes outside of the radial direction from the fitting tubular portion. Further, an area inside of the fitting tubular portion is not covered by the outer conductive body, and a contact portion of the central conductive body is not shielded enough in this area. Accordingly, a pad for shielding must be formed in a corresponding area of the circuit board in order to obtain a shielding effect.

Specifically, when the contact portion of the central conductive body is a female mold, the contact portion must be provided with a spring property to be able to elastically deform. Further, it is difficult to hold the central conductive body in a dielectric body through an integrated molding while maintaining a freedom of elastic deformation.

Accordingly, in the connector disclosed in Patent Reference, the contact portion of the central conductive body is inserted into a hole portion that pierces a center of the dielectric body from top-to-bottom. A connection portion to be connected to the circuit board is bent in an L character shape on a lower edge of the contact portion, and is exposed while extending along a bottom surface of the dielectric body.

Accordingly, when the connection portion is connected to the circuit board with solder, solder flux may rise from the connection portion and adhere to the contact portion. As a result, the solder may deteriorate a contact property of a connection with the mating connector at the contact portion.

When two circuit boards are connected through the coaxial connector, one of the connectors must have a central conductive body of a female mold. Accordingly, the connector disclosed in Patent Reference has the problem described above.

In view of the problems described above, an object of the present invention is to provide a coaxial electrical connector for a circuit board with an improved shielding property and capable of preventing solder flux from rising when soldered.

Further objects and advantages of the invention will be apparent from the following description of the invention.

SUMMARY OF THE INVENTION

In order to attain the objects described above, according to the present invention, a coaxial electrical connector comprises an outer conductive body, a dielectric body, and a central conductive body. The outer conductive body has a fitting portion. An opening portion to fit with a mating connector is formed in the fitting portion on one end portion side in a direction of an axis line. The dielectric body is retained and held inside of the fitting portion.

The central conductive body has a contact portion and is held by the dielectric body. The contact portion contacts with a central conductive body of the mating connector in the direction of the axis line. The outer conductive body has an attachment portion on the other end portion side in the direction of the axis line. The attachment portion is formed of a surface perpendicular to the axis line, and is provided for an attachment to a circuit board.

The central conductive body has a connection portion. The connection portion extends from the dielectric body in a radial direction and is situated on a bottom surface side of the attachment portion.

In the coaxial electrical connector of the present invention, the dielectric body covers at least a part of the retained portion in a longitudinal direction thereof in a middle portion between the contact portion and the connection portion of the central conductive body. Further, the attachment portion extends to substantially cover an area inside of a peripheral border through a joining portion. The joining portion is bent in a part of the peripheral border on the other end portion side of the fitting portion.

According to the present invention, the attachment portion substantially covers a portion in which the contact portion of the central conductive body exists and around the area, or the area inside of the peripheral border of the fitting portion of the outer conductive body, thereby obtaining a good shielding effect against the contact portion. Accordingly, it is not necessary to provide a pad in a corresponding area of the circuit board for shielding.

According to the present invention, when the coaxial connector is attached to the circuit board, an entire surface or an intended part of the attachment surface of the attachment portion is soldered to the circuit board. The attachment surface is formed to be relatively large.

As opposed to a conventional connector, the coaxial connector of the present invention is provided with the attachment portion; thereby preventing solder flux from rising from a lower portion of the contact portion of the central conductive body. Further, the attachment portion functions as a bottom wall of the fitting portion and supports the central conductive body through the dielectric body securely. Accordingly, a displacement or a coming-off in a fitting direction does not occur upon fitting with the central conductive body of the mating connector.

According to the present invention, a terminal is held in the retained portion between the contact portion and the connection portion while being covered by the dielectric body.

Accordingly, solder flux is prevented from rising in the retained portion upon connection with solder.

According to the present invention, the contact portion may be a female mold that has a spring property to receive the central conductive body with a pin shape of the mating connector. The female mold contact portion is required to be able to elastically deform. In this case, the female mold contact portion is held by the retained portion that is a separate part from the contact portion, so that solder flux is prevented from rising.

According to the present invention, the fitting portion may be made of a metal sheet in a cylinder shape. Further, the fitting portion may be made to have a slit portion that extends in an axis line direction in a part of a circumference direction. The slit portion and the joining portion are situated to face each other in a diameter direction of the fitting portion.

When fitting with the mating connector, a diameter expansion of the fitting portion deforms the fitting portion in the slit portion, which generates stress. However, no stress or little stress is transferred to the joining portion. This is because the joining portion is situated on the opposite side against the slit portion in a diameter direction of the fitting portion; that is, the joining portion is the furthest in the circumference direction. Accordingly, strength at the joining portion is not deteriorated.

According to the present invention, the attachment portion may be provided to protrude from the peripheral border of the fitting portion to an outside of the radius. When the attachment portion protrudes, strength of the attachment portion itself is improved, and a surface area of the attachment surface is increased. Further, a length of the protruding direction is increased, so that a moment arm length in the direction is also increased. Accordingly, a bearing force against the moment due to external force is improved.

When the attachment portion protrudes as described above, the attachment portion is preferred to have a rise portion. The rise portion rises from an edge in the protruding direction to one end portion side of an axis line. When the attachment portion is attached to the circuit board with solder, solder flows into a space having a wedge-shape that is provided between a base portion of the rise portion and a surface of the circuit board. Further, a fillet portion is formed. Accordingly, solder improves the attachment strength.

According to the present invention, the dielectric body may be provided such that the retaining portion protrudes from a surrounding range of the fitting portion and the attachment portion reaches the retaining portion. The retaining portion covers and holds the retained portion in a middle portion of the central conductive body. Since a length of the retained portion that is held by the retaining portion is long, a retaining force becomes large. Further, solder flux is further prevented from rising in the retained portion. In addition, the attachment portion covers a broad range. Accordingly, the strength of the attachment portion itself and the attachment strength to the circuit board become large.

As described above, in the present invention, the attachment portion that is connected in the fitting portion and the joining portion substantially covers inside of the fitting portion. Accordingly, a shielding effect against the contact portion of the central conductive body is improved.

Further, the dielectric body covers the portion of the retained portion of the central conductive body in the longitudinal direction. Accordingly, solder flux is blocked at the retained portion even when connected with solder to the circuit board in the connection portion that protrudes from the dielectric body in the radial direction. Accordingly, solder flux is prevented from rising. Further, an attachment surface of the attachment portion can be relatively large. Accordingly, the attachment strength with solder is assured.

BRIEF DESCRIPTION OF THE DRAWINGS

FIGS. 2(A) and 2(B) are perspective views showing the coaxial electrical connector in a finished state according to the first embodiment of the present invention, wherein FIG. 2(A) is an upper side view of the coaxial electrical connector, and FIG. 2(B) is a bottom surface side view of the coaxial electrical connector;

FIGS. 3(A) to 3(D) are views showing the coaxial electrical connector from different directions according to the first embodiment of the present invention, wherein FIG. 3(A) is a front view of the coaxial electrical connector, FIG. 3(B) is a plan view of the coaxial electrical connector, FIG. 3(C) is a right side view of the coaxial electrical connector, and FIG. 3(D) is a bottom view of the coaxial electrical connector;

FIGS. 5(A) and 5(B) are sectional views showing a coaxial electrical connector according to a second embodiment of the present invention, wherein FIG. 5(A) is a sectional view showing the coaxial electrical connector in a middle of an assembly process thereof, and FIG. 5(B) is a sectional view showing the coaxial electrical connector in a finished state.

DETAILED DESCRIPTION OF PREFERRED EMBODIMENTS

Hereunder, embodiments of the present invention will be explained with reference to the accompanying drawings.

First Embodiment

Figure 1:
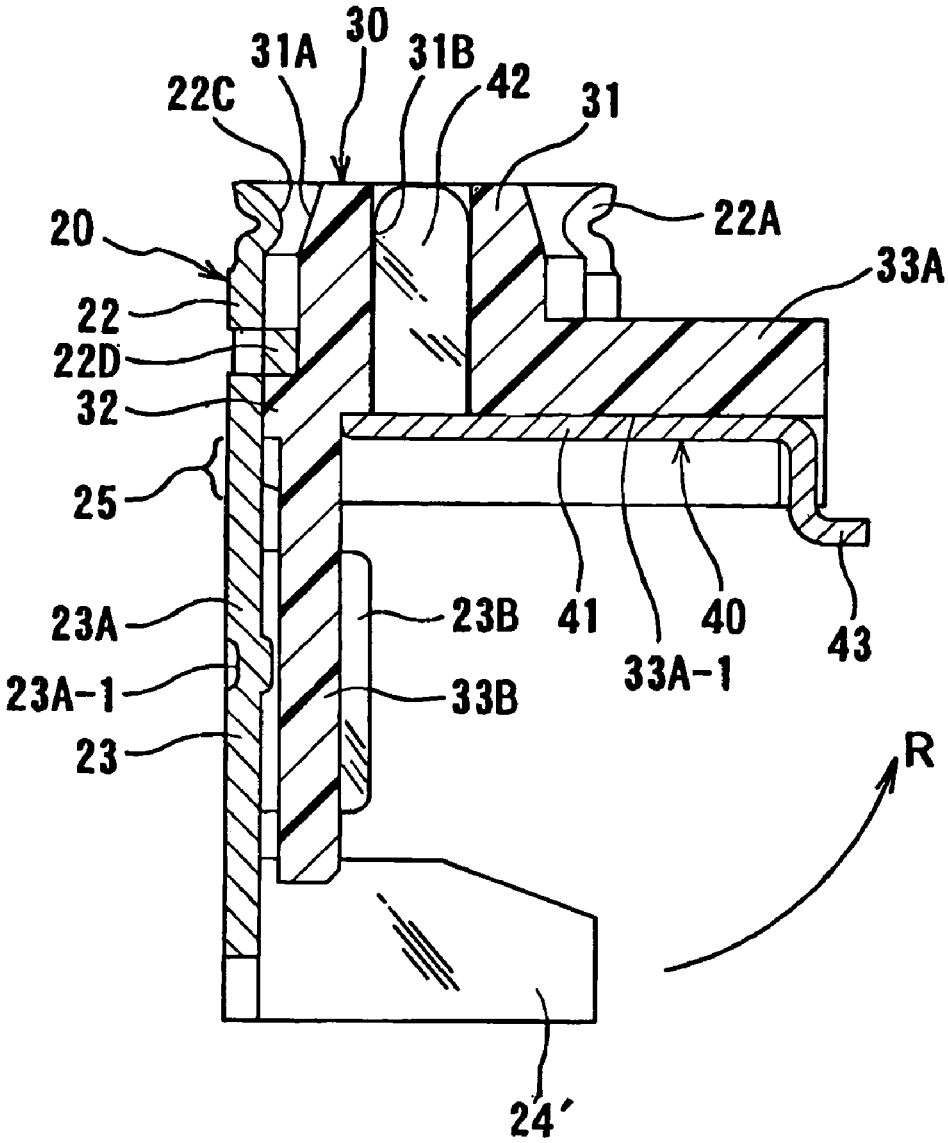
FIG. 1 is a sectional view showing a coaxial electrical connector in a middle of an assembly process thereof according to a first embodiment of the present invention.

A first embodiment of the present invention will be explained. FIG. 1 is a sectional view showing a coaxial electrical connector in a middle of an assembly process thereof according to the first embodiment of the present invention.

Figure 2:
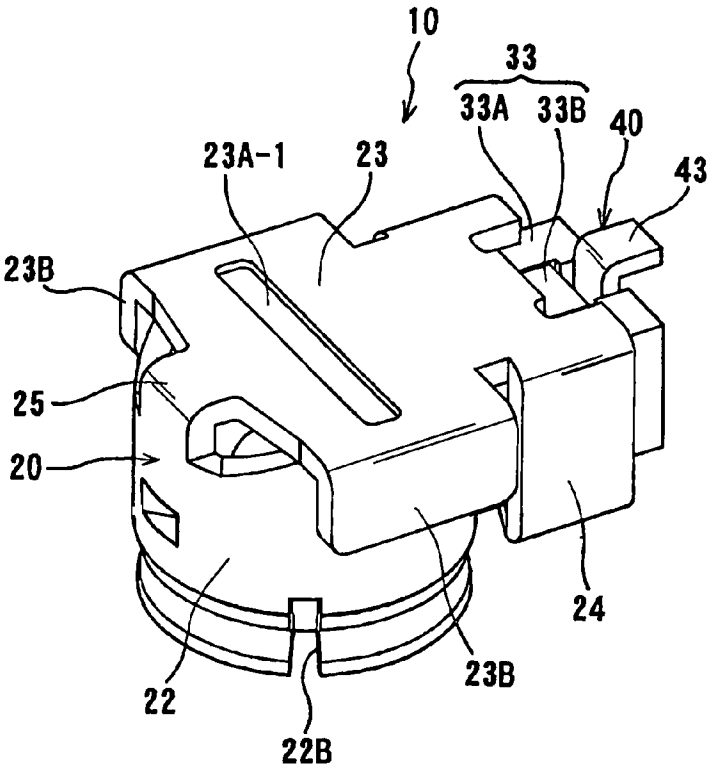
Figure 2:
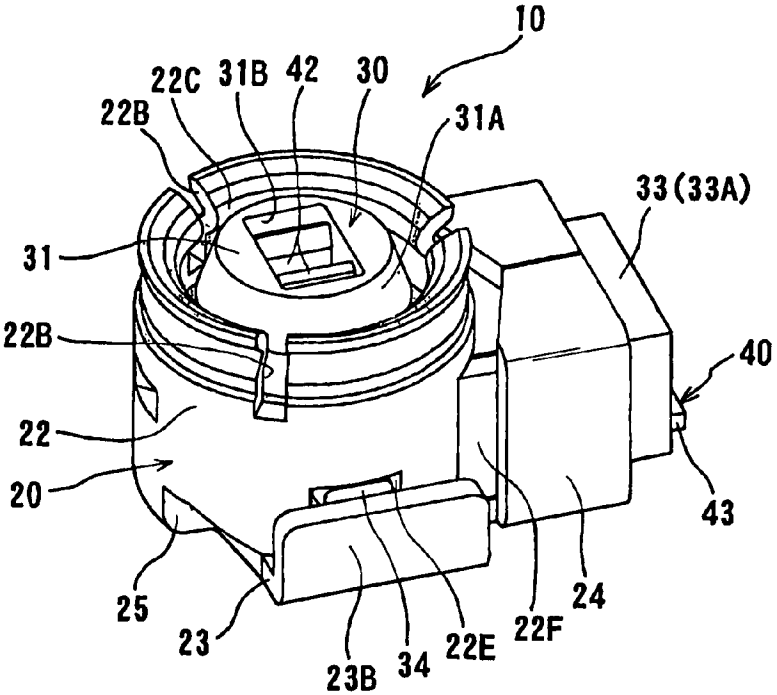

FIGS. 2(A) and 2(B) are perspective views showing the coaxial electrical connector in a finished state according to the first embodiment of the present invention. More specifically, FIG. 2(A) is an upper side view of the coaxial electrical connector (a fitting side thereof relative to a circuit board), and FIG. 2(B) is a bottom surface side view of the coaxial electrical connector (an attachment surface side thereof relative to the circuit board).

Figure 3:
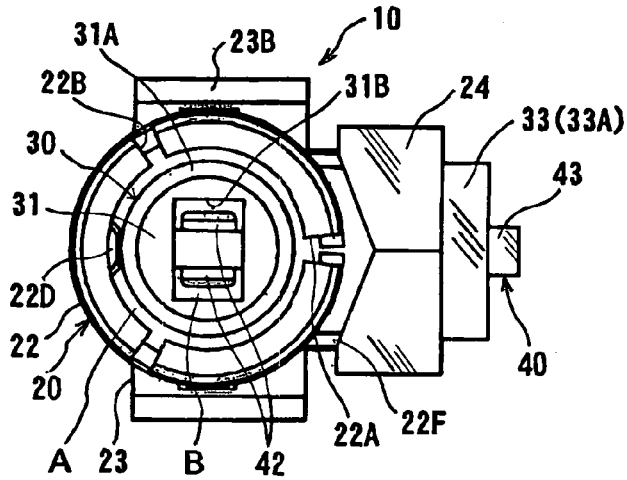
Figure 3:
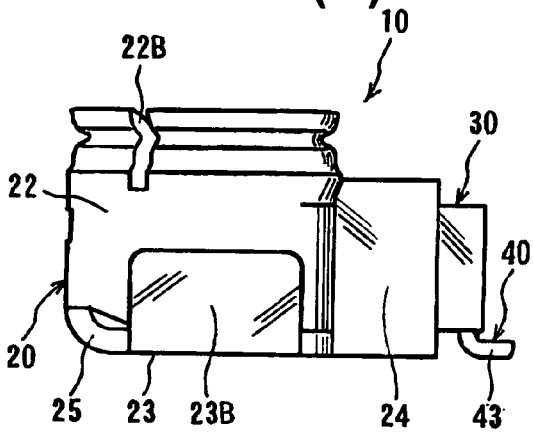
Figure 3:
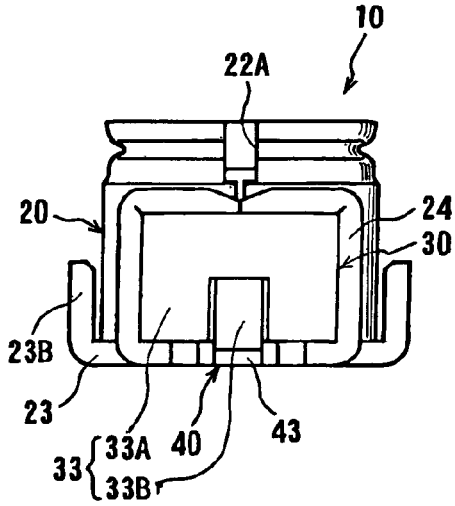
Figure 3:
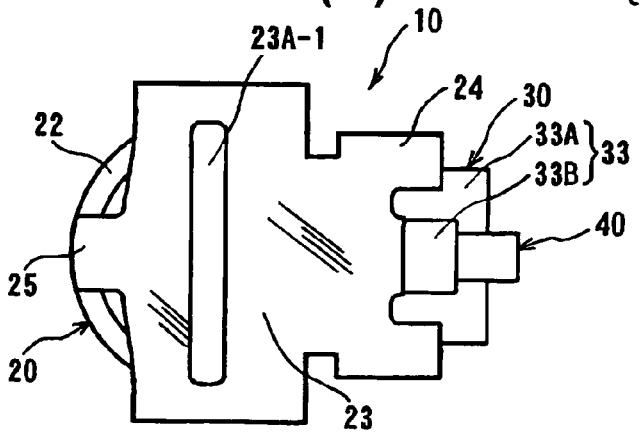

FIGS. 3(A) to 3(D) are views showing the coaxial electrical connector from different directions according to the first embodiment of the present invention. More specifically, FIG. 3(A) is a front view of the coaxial electrical connector, FIG. 3(B) is a plan view of the coaxial electrical connector, FIG. 3(C) is a right side view of the coaxial electrical connector, and FIG. 3(D) is a bottom view of the coaxial electrical connector.

Figure 4:
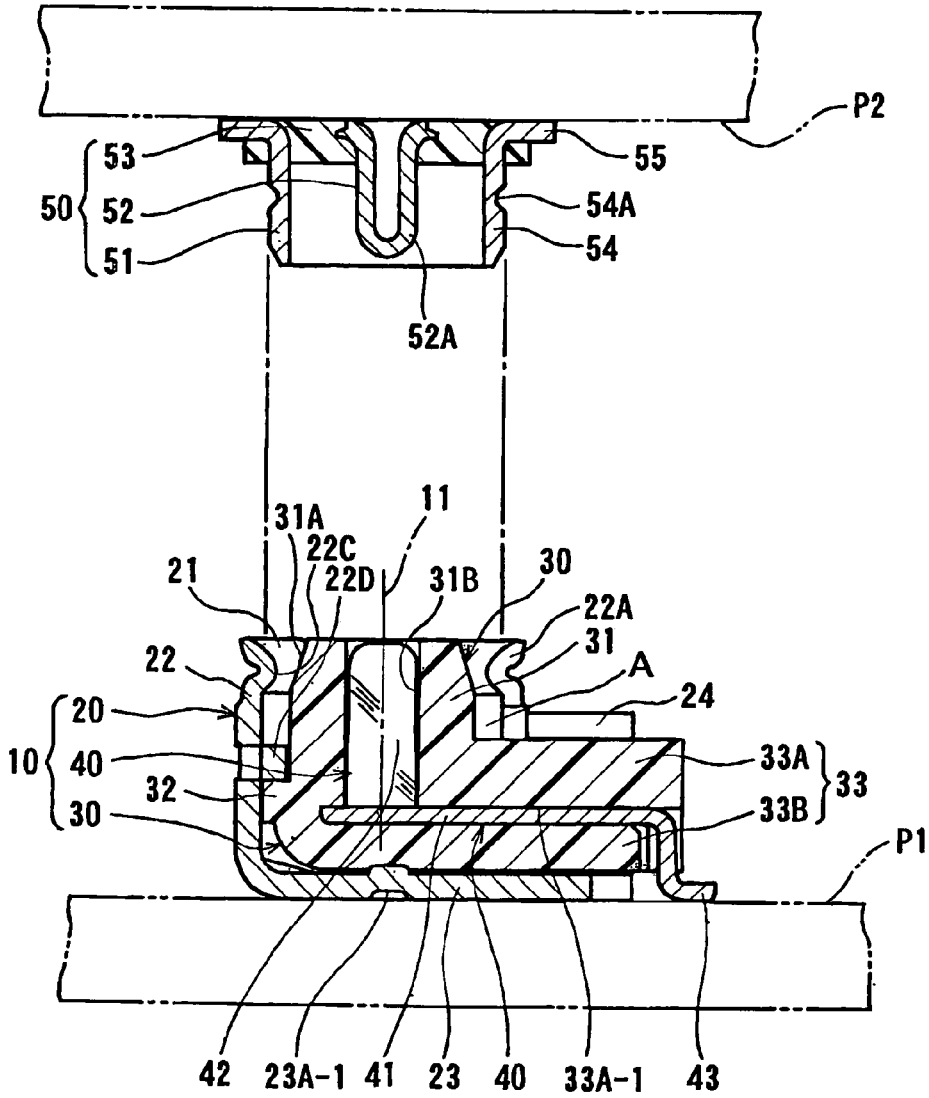
FIG. 4 is a sectional view showing the coaxial electrical connector along with a mating connector according to the first embodiment of the present invention.

FIG. 4 is a sectional view showing the coaxial electrical connector along with a mating connector according to the first embodiment of the present invention.

In the embodiment, as shown in FIG. 4, a coaxial connector 10 is attached to a circuit board P1, and fits into a mating coaxial connector 50 that is attached to the other circuit board P2. Further, the coaxial connector 10 is used to connect the circuit boards P1 and P2 such that the circuit boards P1 and P2 are situated in parallel to each other.

As shown in FIGS. 2(A)-2(B) to 4, the coaxial connector 10 comprises an outer conductive body 20, a dielectric body 30, and a central conductive body 40. The dielectric body 30 is retained and held inside the outer conductive body 20. The dielectric body 30 holds the central conductive body 40.

In the embodiment, the outer conductive body 20 is formed through molding a metal plate. The outer conductive body 20 comprises a fitting portion 22, an attachment portion 23, and a surrounding portion 24. The fitting portion 22 has a tubular shape (e.g. a cylinder shape) centering on an axis line 11 that extends toward a connector fitting direction.

Further, the fitting portion 22 has an opening portion 21 on one end portion side (an upper edge side in FIG. 4) in a direction of an axis line 11. The attachment portion 23 is formed to bend and extend from the fitting portion 22, so that a bottom lid to cover inside of the fitting portion 22 is formed on the other end portion side. The surrounding portion 24 is formed to bend from the attachment portion 23. Further, an arm portion 22F that extends outwardly from the radius from a joint position in a circumference direction of the fitting portion 22 having a tubular shape is provided.

As shown in FIG. 1, when the connector is in a semi-finished state, the attachment portion 23 extends downwardly in a direction of the axis line 11 in a lower edge of the fitting portion 22 through a joining portion 25 that is provided in a part of a circular direction. The joining portion 25 has a width that is narrower than that of the attachment portion 23 of the fitting portion 22B and is curved.

As shown in FIGS. 2(A)-2(B) to 4, the attachment portion 23 is bent at the joining portion 25, so that the attachment portion 23 forms a bottom lid of the fitting portion 22. The outer conductive body 20 will be explained in more detail later in relation to the dielectric body 30.

In the embodiment, the dielectric body 30 is formed of molding an insulation member such as a resin. Further, as shown in FIGS. 22(A)-2(B) to 4 (especially FIG. 4), the dielectric body 30 has a columnar portion 31 and a retaining portion 33. The columnar portion 31 is retained inside of the fitting portion 22 of the outer conductive body 20 to be concentric with the fitting portion 22. The retaining portion 33 extends outwardly from the radius from the columnar portion 31.

In the embodiment, a circular space A is formed between a top half of the columnar portion 31 and the fitting portion 22 of the outer conductive body 20. Further, an outer conductive body of the mating connector having a tubular shape is received in the circular space A. The outer conductive body of the mating connector is fitted into from the opening portion 21 of the fitting portion 22. The columnar portion 31 has a taper portion 31A on a top edge thereof to receive the outer conductive body of the mating connector with ease.

In the embodiment, a protruding portion 32 is formed around a bottom half of the columnar portion 31 and protrudes toward a radial direction. Further, an outer circumference surface of the protruding portion 32 is adjacent to an inner circumference surface of the fitting portion 22. Accordingly, an interval of a radial direction of the circular space A is maintained constant. A square hole 31B having a square section is formed in the columnar portion 31 on the axis line 11. The square hole 31B opens upwardly and extends downwardly.

In the embodiment, the retaining portion 33 of the dielectric body 30 extends outwardly from the circle that the fitting portion 22 draws in a radial direction of a part of the circumference direction from a lower half portion of the columnar portion 31. The retaining portion 33 has an external shape that is a rectangular shape in a section of the surface that is perpendicular to an extending direction (shown in FIG. 3(C)).

The retaining portion 33 comprises a main portion 33A that is situated on an upper side and a sub portion 33B that is situated on a lower side. Further, the main portion 33A and the sub portion 33B closely contact with a portion of the retained portion of the central conductive body 40 in a longitudinal direction (described later) to hold the retained portion. The close contact and retention is provided in a section of a surface that is perpendicular to the longitudinal direction of the retained portion in a whole circumference surface area of the retaining portion.

As shown in FIG. 3(C), the main portion 33A opens downwardly and is provided with a retaining groove 33A-1 that extends in an extending direction of the retaining portion 33 on a lower surface. The retaining groove 33A-1 communicates with a lower portion opening of the square hole 31B in a position of the axial line 11 in a radial direction. The square hole 31B is formed in the columnar portion 31.

In the embodiment, the retaining portion 33 retains the sub portion 33B inside of the retaining groove 33A-1 of the main portion 33A. In the state, an external surface having a rectangular section is formed in a surface perpendicular to the extending direction of the retaining portion 33. Further, the retained portion of the central conductive body (described later) is pressed and held between a groove bottom surface of the main portion 33A and the sub portion 33B.

As shown in FIG. 1, when the connector is in a semi-finished state, the sub portion 33B extends downwardly along the attachment portion 23 from a lower portion of the columnar portion 31 in a position adjacent to the joining portion 25 of the outer conductive body 20. The sub portion 33B is pressed and bent by the attachment portion 23 in the same direction as the attachment portion 23 when the attachment portion 23 of the outer conductive body 20 is bent at the joining portion 25. Accordingly, the sub portion 33B is retained in the retaining groove 33A-1.

The outer conductive body 20 will be explained in more detail. The fitting portion 22 of the outer conductive body 20 is made through rounding a metal plate to form a tubular shape around the axis line 11. The circumference direction edge portions of the metal plate are put together to face each other to form a tubular shape.

The edge portion 22A of the facing circumference direction is situated to be in the same position as the retaining portion 33 of the dielectric body 30 in the circumference direction. The fitting portion 22 is provided with a cut portion that allows the retaining portion 33 to be extended. Further, the arm portion 22F that extends outwardly from the radius is provided from the edge of the cut portion.

In the embodiment, slit portions 22B are provided with the fitting portion 22 on the upper edge thereof and extend in a direction parallel to the axis line 11. The slit portions 22B open at a plurality of positions in a circumference direction. An interval between the edge portions 22A in the circumference direction reaches up to a lower edge thereof in the axis line 11 direction of the fitting portion 22. On the other hand, the slit portions 22B reach only up to the middle position.

In the embodiment, a circular protruding portion 22C is provided in a range in the direction of the axis line 11 in which the slit portions 22B are formed. The circular protruding portion 22C extends inwardly from the radius of the fitting portion 22.

When the outer conductive body of the mating connector having a tubular shape fits into the fitting portion 22, an interval between the slit portions 22B and an interval between the circumference direction edges 22A provide elasticity to the fitting portion 22 to enlarge the radius. Further, the circular protruding portion 22C fits into the circular recess portion to provide a lock mechanism. The circular recess portion is formed on an outer circumference surface of the outer conductive body of the mating connector.

In the embodiment, an engagement portion 22D is provided in the middle portion of the fitting portion 22 in the direction of the axis line 11. A part of the engagement portion 22D is cut inwardly in a radial direction. The engagement portion 22D engages with an upper face of the protruding portion 32 of the dielectric body 30 to position the dielectric body 30 in the direction of the axis line 11. Further, the recess portion 22 is provided on a lower edge of the fitting portion 22 and engages with an engagement portion 34 of the dielectric body 30.

As shown in FIG. 1, when the connector is in the semi-finished state, the attachment portion 23 of the outer conductive body 20 extends downwardly in the direction of the axis line 11. The attachment portion 23 comprises a lid portion 23A (a flat surface perpendicular to a sheet surface in FIG. 1) and rise portions 23B.

The lid portion 23A covers an inside area of the fitting portion 22 when bent at the joining portion 25 to a direction indicated by an arrow R. The rise portions 23B are bent on both ends of the lid portion 23A (both ends in a direction perpendicular to a sheet surface in FIG. 1) and has a surface parallel to a sheet surface.

In the embodiment, a distance between the rise portions 23B of both ends is larger than an outer diameter of the fitting portion 22. After bending at the joining portion 25, the rise portions 23B are made to position on both sides of the fitting portion 22 in a diameter direction of the fitting portion 22.

In the embodiment, an embossing portion 23A-1 is provided with the lid portion 23A on an extension of the axis line direction of a contact portion 42 of the central conductive body 40 for reinforcement. The embossing portion 23A-1 extends in a direction toward the rise portions 23B. Surrounding piece 24' is formed to be bent from the both ends of a lower portion of the attachment portion 23 shown in FIG. 1. The surrounding piece 24' has surfaces parallel to a sheet surface. The surrounding piece 24' is bent further after the attachment portion 23 is bent at the joining portion 25.

As shown in FIGS. 2(A)-2(B) to 4, the surrounding portion 24 is formed. The surrounding portion 24 surrounds the outer circumference surface of the retaining portion 33 (that is, the main portion 33A and the sub portion 33B that has been bent) of the dielectric body 30. Further, the lid portion 23A covers the fitting portion 22 on the bottom portion side. In addition, after the surrounding portion 24 is bent to form, the lid portion 23A holds the main portion 33A and the sub portion 33B of the dielectric body 30 securely.

In the embodiment, the central conductive body 40 is made through molding a metal plate. Further, the central conductive body 40 comprises a retained portion 41, the contact portion 42, and a connection portion 43. The retained portion 41 has a flat band shape. The contact portion 42 comprises two elastic pieces that extend in parallel. The two elastic pieces of the contact portion 42 are bent to be perpendicular to a surface of the retained portion 41 from the side edge in one of the edge portions of a longitudinal direction of the retained portion 41.

The connection portion 43 is formed through bending from the other edge portion of the retained portion 41 to a crank. The retained portion 41 has an appropriate thickness, a width, and a length to be retained in the retaining groove 33A-1.

The retaining groove 33A-1 is formed in the main portion 33A of the retaining portion 33 of the dielectric body 30. Further, the two elastic pieces of the contact portion 42 that are parallel to each other are inserted into the square hole 31B of the dielectric body 30, so that an upper edge of the contact portion 42 reaches near a position of an opening edge of an upper edge of the square hole 31B.

In the embodiment, a space B is provided between the elastic pieces and the inner wall surface of the square hole 31B. The space B allows the two elastic pieces to be elastically deformed to be away from each other toward a plate thickness direction thereof. A distance between the two elastic pieces is determined to receive and elastically press a male type central conductive body of the mating connector having an axial shape.

As shown in FIG. 4, the bottom surface of the connection portion 43 of the central conductive body 40 is substantially flush with the bottom surface of the attachment portion 23 when the attachment portion 23 of the outer conductive body 20 is bent at the joining portion 25 and the attachment portion 23 bends and holds the sub portion 33B of the dielectric body 30.

Next, an assembly of the connector according to the embodiment will be explained. The connector will be assembled as shown in FIG. 4 after being in a state shown in FIG. 1.

First, the attachment portion 23 as shown in FIG. 1 is incorporated with the outer conductive body 20 that extends in the direction of the axis line 11. Further, the sub portion 33B of the retaining portion 33 is incorporated with the dielectric body 30 that extends to be parallel to the attachment portion 23. Further, the central conductive body 40 is attached to the dielectric body 30. Alternatively, the dielectric body 30 to which the central conductive body 40 is attached is incorporated with the outer conductive body 20. Accordingly, the connector is obtained in the semi-finished state.

Next, the attachment portion 23 of the connector in the semi-finished state is bent at the joining portion 25 toward the bottom portion of the dielectric body 30 in a direction R shown in FIG. 1.

When the attachment portion 23 is bent at the joining portion 25, the lid portion 23A of the attachment portion 23 presses the sub portion 33B of the dielectric body 30. At this time, the lid portion 23A of the attachment portion 23 bends the sub portion 33B along with itself in the same direction.

The sub portion 33B is retained in the retaining groove 33A-1 of the dielectric body 30. The sub portion 33B forms the retaining portion 33 along with the main portion 33A in which the retaining groove 33A-1 if formed. Further, the retained portion 41 of the central conductive body 40 is held between the main portion 33A and the sub portion 33B in a part of the longitudinal direction thereof (a right portion in the drawing).

In this state, the lid portion 23A of the attachment portion 23 configures a shape of a bottom lid that substantially covers the area inside of the fitting portion 22 on the bottom portion side of the fitting portion 22. Accordingly, the dielectric body 30 keeps holding the central conductive body 40. Further, the bottom portion is nearly entirely shielded. Accordingly, the connector 10 as a single body obtains a capability of a specific coaxial connector. Further, the rise portions 23B of the attachment portion 23 is situated on both sides to hold the fitting portion 22 in a diameter direction.

The surrounding piece 24' of the outer conductive body 20 faces both side walls of the retaining portion 33 (both sides parallel to a sheet surface in FIG. 1), so that the distal portions thereof extend beyond the both side walls. Then, the surrounding piece 24' is bent, so that the distal portions that extend face an upper face of the retaining portion 33.

Accordingly, the surrounding piece 24' forms the surrounding portion 24 that surrounds the retaining portion 33 along with the arm portion 22F of the outer conductive body 20. This ensures that the main portion 33A and the sub portion 33B closely contact with each other in the retained portion 41 of the central conductive body 40, which strengthens retention of the retained portion 41 between the main portion 33A and the sub portion 33B. Accordingly, the connector in the semi-finished state shown in FIG. 1 becomes the connector in the finished state as shown in FIG. 4.

As shown in FIG. 4, in the connector 10 of the embodiment, the connection portion 43 of the central conductive body 40 and the attachment portion 23 of the outer conductive body 20 are connected with the respective corresponding portions of the circuit board P1 with solder.

As shown in FIG. 4, the mating connector 50 that is fitted into the connector 10 is attached to the other circuit board P2.

The mating connector 50 comprises an outer conductive body 51, a central conductive body 52, and a dielectric body 53. The outer conductive body 51 has a tubular shape. The central conductive body 52 has an axial shape and is a male type. The dielectric body 53 holds the outer conductive body 51 and the central conductive body 52 to be incorporated.

The outer conductive body 51 is made through molding a metal plate. Further, the outer conductive body 51 has a tubular portion 54 and an attachment portion 55 that extends outwardly from the radius to be flanged. The circular groove portion 54A is formed on the outer circumference surface of the tubular portion 54.

The circular groove portion 54A engages with the circular protruding portion 22C that is formed on an inner circumference of the fitting portion 22 of the outer conductive body 20 of the coaxial connector 10. The circular protruding portion 22C and the circular groove portion 54A engage with each other, so that the connectors 10 and 50 are locked with each other upon fitting.

The central conductive body 52 has a contact portion 52A. The contact portion 52A having an axial shape is made through metal drawing compound. The distal portion thereof spreads in a semi-circular shape. Further, the base portion thereof spreads in a trumpet shape.

A connection portion extends in a radial direction from the base portion in a part of a circumference direction (not shown in FIG. 4 since the connection portion extends in a direction perpendicular to a sheet surface). The contact portion 52A of the central conductive body 52 is situated on an axis line of the tubular portion 54 of the outer conductive body 51.

The central conductive body 52 is held along with the outer conductive body 51 in a bottom portion (upper portion in FIG. 4) of the tubular portion 54 to maintain the position through an integrated molding of the dielectric body 30. A circular space is provided between the tubular portion 54 and the contact portion 52A. The circular space forms a space for fitting with the coaxial connector 10.

In the embodiment, the coaxial connector described above is used as follows.

First, the coaxial connector 10 is attached to the circuit board P1. More specifically, the lid portion 23A of the attachment portion 23 of the outer conductive body 20 and the connection portion 43 of the central conductive body 40 are connected to the respective corresponding portions of the circuit board P1 with solder.

At this time, the attachment portion 23 can be connected to the circuit board P1, so that the entire surface or an intended portion of the lid portion 23A is soldered to the circuit board P1. In either case, it is possible to solder in a range of the lid portion 23A having a large area, which increases the attachment strength.

Specifically, when a moment to incline the connector toward a surface of the circuit board is applied as an external force, a facing force against the moment is increased. When a groove is provided on a bottom surface of the lid portion 23A, so that molten solder enters into the groove, the attachment strength is further increased.

As described above, the attachment strength at the attachment portion is large. Accordingly, it is ensured that even a connector having a female mold central conductive body that is large has enough strength. Further, a fillet is formed in a space with the circuit board on a bent surface that borders between the lid portion 23A and the rise portion 23B, which increases the attachment strength.

In addition, the rise portion 23B is situated to cover a recess portion 22E that is formed in the fitting portion 22. Accordingly, it is prevented that solder enters into the recess portion 22E.

Further, when the connector 10 is attached to the circuit board P1, the mating connector 50 is attached to the other circuit board P2. More specifically, the attachment portion 55 of the outer conductive body 51 and the connection portion of the central conductive body 52 are connected to the respective corresponding portions of the circuit board P2 with solder.

The connector according to the embodiment has the large attachment strength as described. Accordingly, the attachment strength is large enough even though the circuit board to which the connector is attached is a flexible substrate (FPC, FFC).

The connectors 10 and 50 described above are fitted into each other in the axial body direction, as shown in FIG. 4. Further, the circuit boards P1 and P2 are electrically connected with each other.

Second Embodiment

A second embodiment of the present invention will be explained next. The present invention is not limited to the first embodiment shown in FIGS. 2(A)-2(B) to 4, and variations are possible. For example, the dielectric body 30 is formed as a single member in the first embodiment. In the second embodiment, the sub portion 33B of the dielectric body 30 is split and the dielectric body 30 is formed of two members.

Figure 5:
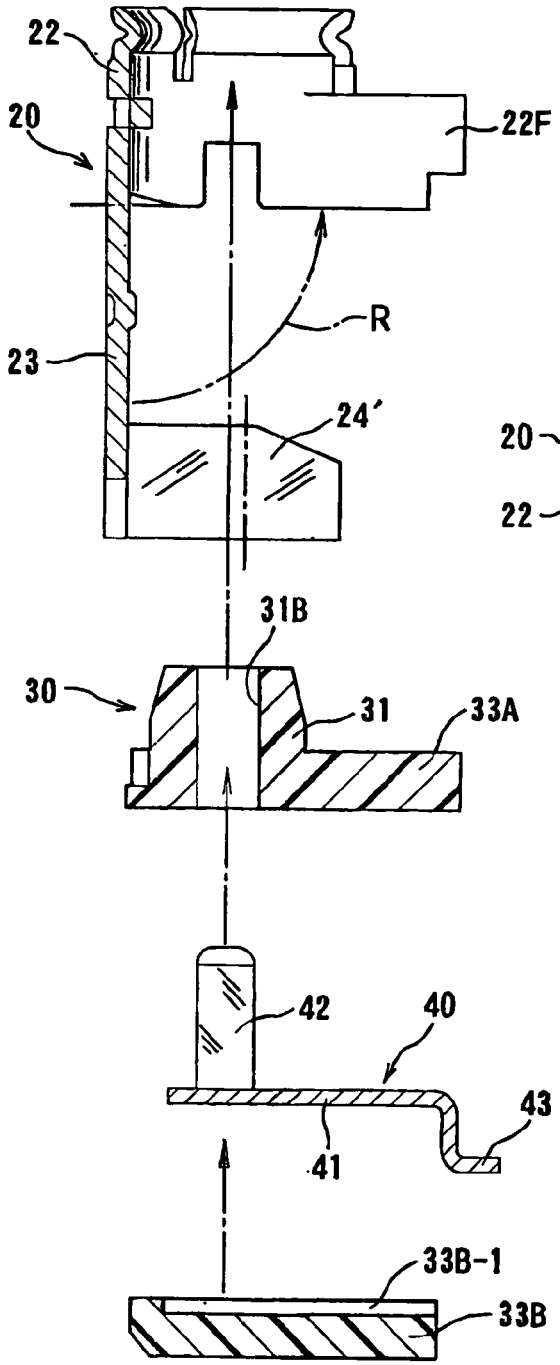
Figure 5:
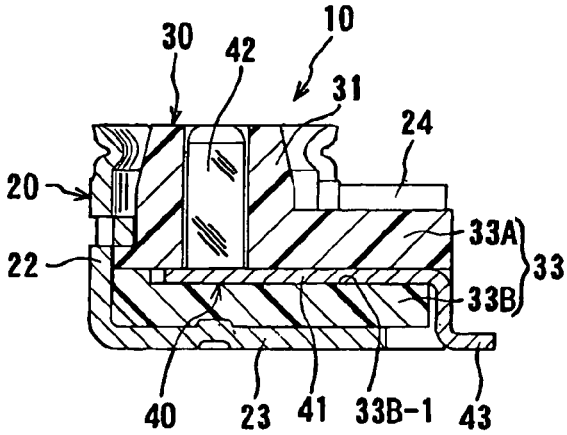

FIGS. 5(A) and 5(B) are sectional views showing a coaxial electrical connector according to the second embodiment of the present invention. More specifically, FIG. 5(A) is a sectional view showing the coaxial electrical connector in a middle of an assembly process thereof, and FIG. 5(B) is a sectional view showing the coaxial electrical connector in a finished state.

In the embodiment, as shown in FIGS. 5(A) and 5(B), the outer conductive body 20 and the central conductive body 40 are the same as those in the first embodiment, except that the attachment portion 23 of the outer conductive body 20 does not have the rise portion. Therefore, explanations of the outer conductive body 20 and the central conductive body 40 are omitted.

In the dielectric body 30 shown in FIG. 5(A), the columnar portion 31 and the main portion 33A are formed to be an integrated in a single member, while the sub portion 33B is formed to be a separate member.

Further, the retaining groove to retain the retained portion 41 of the central conductive body 40 is provided in the main portion in the first embodiment. On the other hand, a retaining groove 33B-1 is provided in the upper face of the sub portion 33B in the second embodiment; and thereby the lower surface of the main portion 33A is formed to be a flat surface.

In the embodiment, when the coaxial connector is assembled, the central conductive body 40 is incorporated into the columnar portion 31 after the columnar portion 31 of the dielectric body 30 and a member of the main portion 33A are incorporated into the outer conductive body 20. At this time, similar to the first embodiment, the central conductive body 40 can be first incorporated into the columnar portion 31, which can be subsequently incorporated into the outer conductive body.

After that, the attachment portion 23 of the outer conductive body 20 is bent at the joining portion 25 in a direction R in FIG. 5(A). The joining portion 25 constitutes a border with the fitting portion 22 having a tubular shape. The attachment portion 23 is adjacent to the bottom surface of the sub portion 33B. Further, the surrounding piece 24' extends upwardly from the retaining portion 33 of the dielectric body 30.

Accordingly, the extended portion from the retaining portion 33 is bent to adjacent to the upper face of the main portion 33A of the retaining portion 33 to be completed as shown in FIG. 5(B). The bend at the joining portion 25 and the bend of the extended portion are the same as the case of the previous embodiment.

The disclosure of Japanese Patent Application No. 2007-115233, filed on Apr. 25, 2007 is incorporated in the application by reference.

While the invention has been explained with reference to the specific embodiments of the invention, the explanation is illustrative and the invention is limited only by the appended claims.

What is claimed is:

1. A coaxial electrical connector, comprising:

an outer conductive body including a fitting portion, said fitting portion including an opening portion for receiving a mating connector on one end portion side of the outer conductive body in a direction of an axis line of the outer conductive body, said outer conductive body further including an attachment portion formed of a plate extending perpendicular to the axis line on the other end portion side thereof in the direction of the axis line for attaching to a circuit board, said attachment portion extending through a joining portion bent at a part of a peripheral border of the fitting portion on the other end portion side so that the attachment portion covers substantially an area inside the peripheral border;

a dielectric body retained in the fitting portion; and a central conductive body held in the dielectric body and including a contact portion for contacting a mate central conductive body of the mating connector in the direction of the axis line, said central conductive body further including a connection portion extending from the dielectric body in a radial direction and situated on a bottom surface of the attachment portion, said central conductive body further including a retained portion between the contact portion and the connection portion so that the dielectric body covers at least a part of the retained portion in a longitudinal direction thereof.

2. The coaxial electrical connector according to claim 1, wherein said contact portion is formed of a female mold with a spring property for receiving the mate central conductive body.

3. The coaxial electrical connector according to claim 1, wherein said fitting portion is formed of a metal sheet with a cylinder shape, said fitting portion including a slit portion extending in the direction of the axis line in the peripheral border thereof, said slit portion being situated to face the joining portion in a diameter direction of the fitting portion.

4. The coaxial electrical connector according to claim 1, wherein said attachment portion protrudes toward outside beyond the peripheral border.

5. The coaxial electrical connector according to claim 1, wherein said attachment portion includes a rise portion extending from an edge thereof toward the one end portion side.

6. The coaxial electrical connector according to claim 1, wherein said dielectric body includes a retaining portion for covering and holding the retained portion so that the attachment portion reaches the retaining portion.

* * * * *